US006568790B1

(12) United States Patent
Sugiyama

(10) Patent No.: US 6,568,790 B1
(45) Date of Patent: May 27, 2003

(54) PRINTER

(75) Inventor: Yuichi Sugiyama, Mitaka (JP)

(73) Assignee: Copyer Co. Ltd., Tokyo (JP)

( * ) Notice: Subject to any disclaimer, the term of this patent is extended or adjusted under 35 U.S.C. 154(b) by 0 days.

(21) Appl. No.: 09/937,612

(22) PCT Filed: Mar. 31, 2000

(86) PCT No.: PCT/JP00/02096

§ 371 (c)(1),
(2), (4) Date: Jan. 23, 2002

(87) PCT Pub. No.: WO00/58102

PCT Pub. Date: Oct. 5, 2000

(30) Foreign Application Priority Data

Mar. 31, 1999 (JP) ..... 11/094240

(51) Int. Cl.[7] ..... B41J 2/21; B41J 2/145; B41J 2/15

(52) U.S. Cl. ..... 347/43; 347/40

(58) Field of Search ..... 347/43, 40

(56) References Cited

U.S. PATENT DOCUMENTS 4,803,500 A * 2/1989 Milbrandt ..... 347/43
5,371,531 A * 12/1994 Rezanka et al. ..... 347/43
5,587,730 A * 12/1996 Karz ..... 347/43

* cited by examiner

*Primary Examiner*—Thinh Nguyen
(74) *Attorney, Agent, or Firm*—Rabin & Berdo, P.C.

(57) ABSTRACT

This invention provides a printing system capable of minimizing the blurring of ink which would otherwise accompany color printing, and of reducing the time required for color printing. A first black printer head 12*a*1, and color printer heads 12*b*1 to 12*b*3 are arrayed in parallel along the direction in which a carriage moves. A second black printer head 12*a*2 is placed such that it is displaced by a certain distance in the medium advance direction with respect to the array comprising the first black printer head 12*a*1 and color printer heads 12*b*1 to 12*b*3, and prints dots such that the dots do not overlap with those printed by the first black printer head 12*a*1 or by the color printer heads 12*b*1 to 12*b*3 within any given band. A control unit 100, when dealing with the image data for a band which concern with a full color image, causes the second black printer head 12*a*2 and color printer heads 12*b*1 to 12*b*2 to exercise printing, and, when dealing with the image data for a band which concern with a black-and-white image, causes the first and second black printer heads 12*a*1 and 12*a*2 to exercise printing.

8 Claims, 7 Drawing Sheets

PRINTER

TECHNICAL FIELD

The present invention relates to a printing system such as a printer or a plotter, particularly to a printing system equipped with a plurality of printer heads suitable for color printing.

BACKGROUND ART

Conventionally, a printing system such as a large printer or plotter based on bubble jet printing incorporates a plurality of printer heads for color printing. The plurality of printer heads are arrayed in parallel along the direction in which the carriage moves, and the printer heads incorporate their respective inks, for example, four colored inks consisting of black (Bk), cyan (C), magenta (M), and yellow (Y) inks. The printer heads move together with the carriage, and, while moving, eject, through the nozzles, their respective inks at a specified timing according to given image data, thereby printing an image having the same width with that of the nozzle of one printer head onto a print medium.

Color printing must meet more complicated needs than would be imagined from a cursory look: it deals with the printing of widely varied colored images ranging from simple images primarily composed of lines such as layouts to full-color images such as colored photographs. For example, if an image primarily composed of lines such as a layout must be printed, it is necessary to reproduce the quality of lines, but it is not always necessary to faithfully reproduce the original color of the layout. Indeed, if an image primarily composed of lines is printed, black ink will be preferentially consumed. However, when an image primarily composed of lines is printed, the printed image must be durable (waterproof and weatherproof). Therefore, for such printing, inks prepared from pigments are frequently used. On the other hand, if a full-color image must be printed, it is necessary to reproduce not only the quality of lines but the color of the original image. Therefore, for such full-color printing, utmost efforts have been paid for eliminating unevenness in the printing of color. As one of the means to achieve this, ink used for full-color printing is preferentially prepared from dyes because such ink will allow a comparatively more faithful reproduction of the color of the original image. Accordingly, for a printing system intended to be used for printing full-color images as well as simple graphic images primarily composed of lines, usually a black ink is chosen from inks prepared from pigments, while colored inks (cyan, magenta, yellow) are chosen from inks prepared from dyes.

Ink prepared from pigments, although it is excellent in its water- and weather-proofness, is awkwardly slow to dry. Because of this, if pigment-based and dye-based inks are used simultaneously in printing, a dot printed with pigment-based ink, if put adjacent to a dot printed with dye-based ink, will be blurred. To avoid the blurring of a dot of pigment-based ink printed adjacent to a dot of dye-based ink which would result when the two kinds of dots are printed simultaneously in color printing, the conventional printing system has adopted a method whereby it is possible to print the dots of colored inks in advance of the dots of black ink, instead of printing the two kinds of dots simultaneously. However, this method poses another problem, that is, printing based on this method requires an unduly long time.

DISCLOSURE OF THE INVENTION

This invention was proposed with the above situation as a background, and aims at providing a printing system which will be able to effectively minimize the blurring of ink dots which would otherwise accompany color printing, as well as to reduce the time required for color printing.

To achieve the above object, this invention will provide a printing system comprising: a first black printer head to eject black ink and a plurality of color printer heads to eject colored inks other than black ink both of which are arrayed in parallel along the direction in which a carriage moves; and a second black printer head to eject black ink which is displaced by a certain distance in the direction in which a print medium will be transferred, with respect to the array comprising the first black printer head and the plural color printer heads, whereby it is possible for the second black printer head to print dots such that the dots do not overlap with those printed by the first black printer head or by the plural color printer heads within any given band.

According to this printing system, if an image data for a band concern with a full color image, it is preferable to print the colored image for the band by using the second black printer head and the plural color printer heads. On the other hand, if an image data for a band concern with a black-and-white image, it is preferable to print the black-and-white image for the band by using the first and second black printer heads simultaneously.

BRIEF DESCRIPTION OF THE DRAWINGS

FIG. 2(*b*) a schematic bottom view of the same printer head portion; and FIG. 2(*c*) a partially enlarged schematic diagram of the printer head portion of FIG. 2(*b*).

BEST MODE FOR CARRYING OUT THE INVENTION

Figure 1:
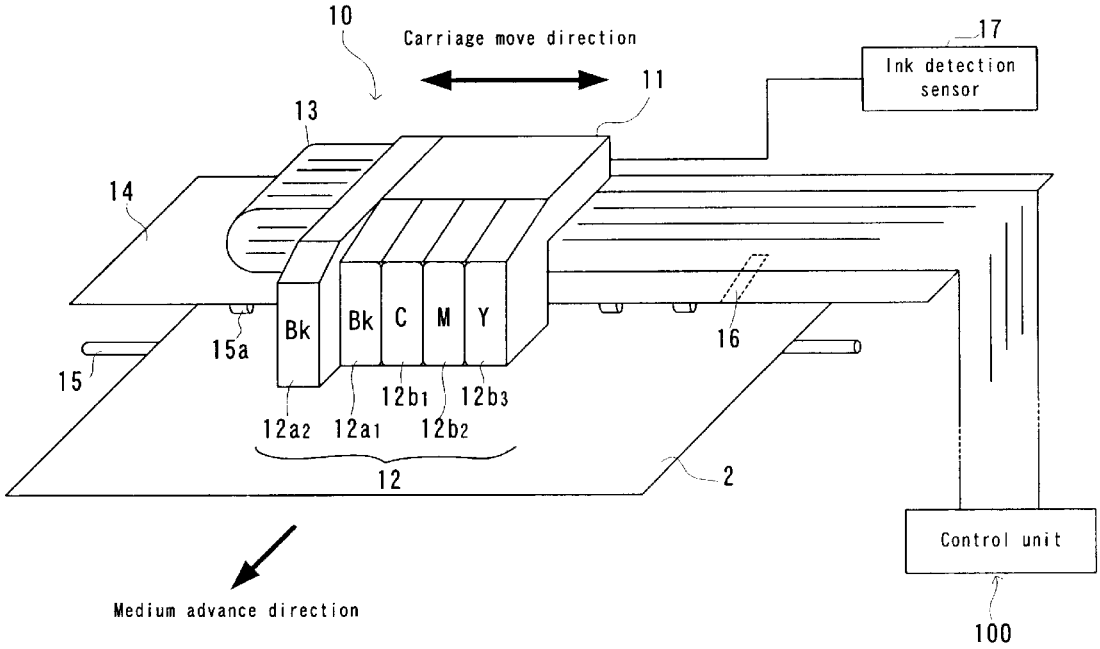
FIG. 1 is a schematic perspective view of the printer unit of a printing system representing an embodiment of this invention.
Figure 2:
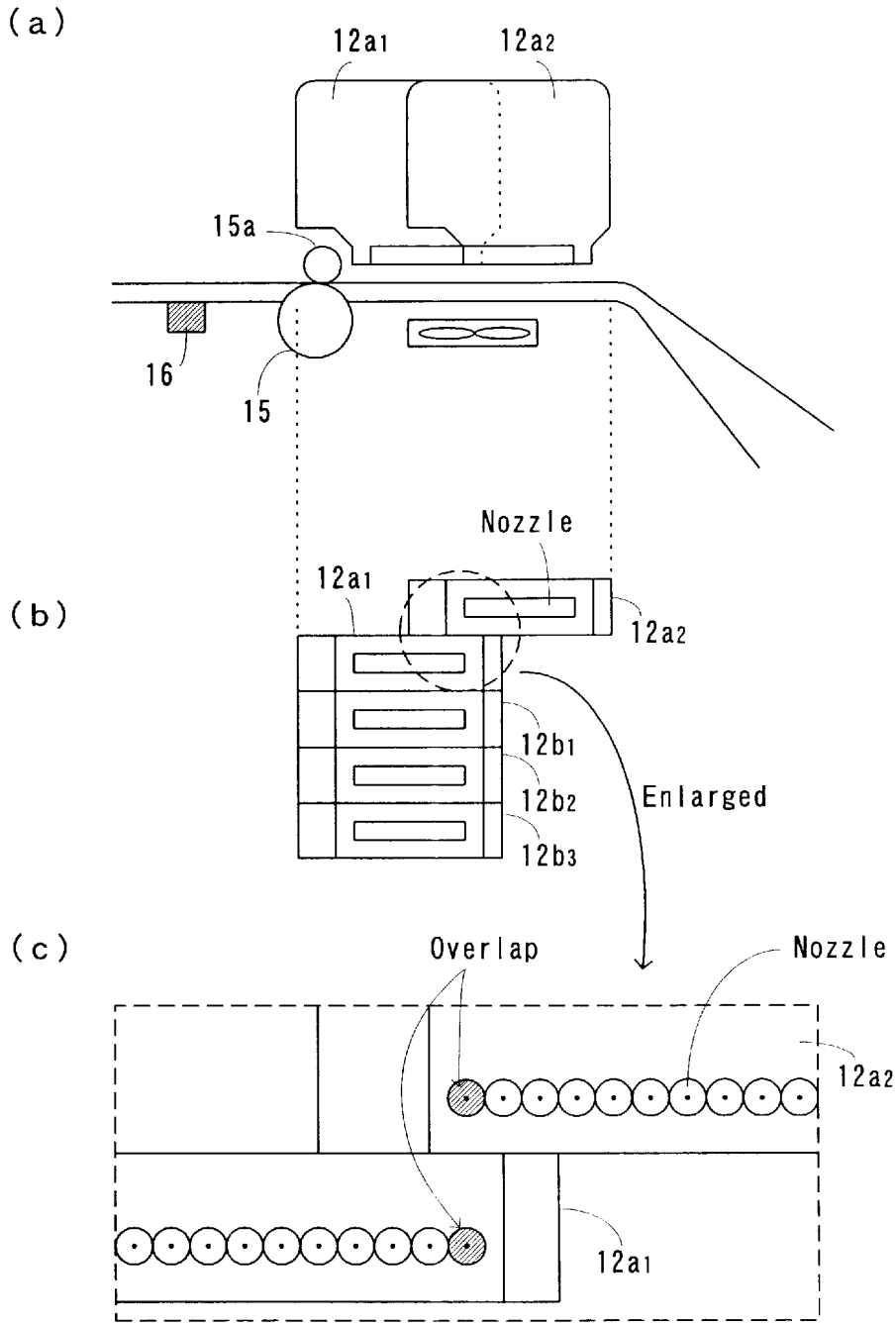
FIG. 2(*a*) is a schematic lateral view of the printer head portion of the printing system.
Figure 3:
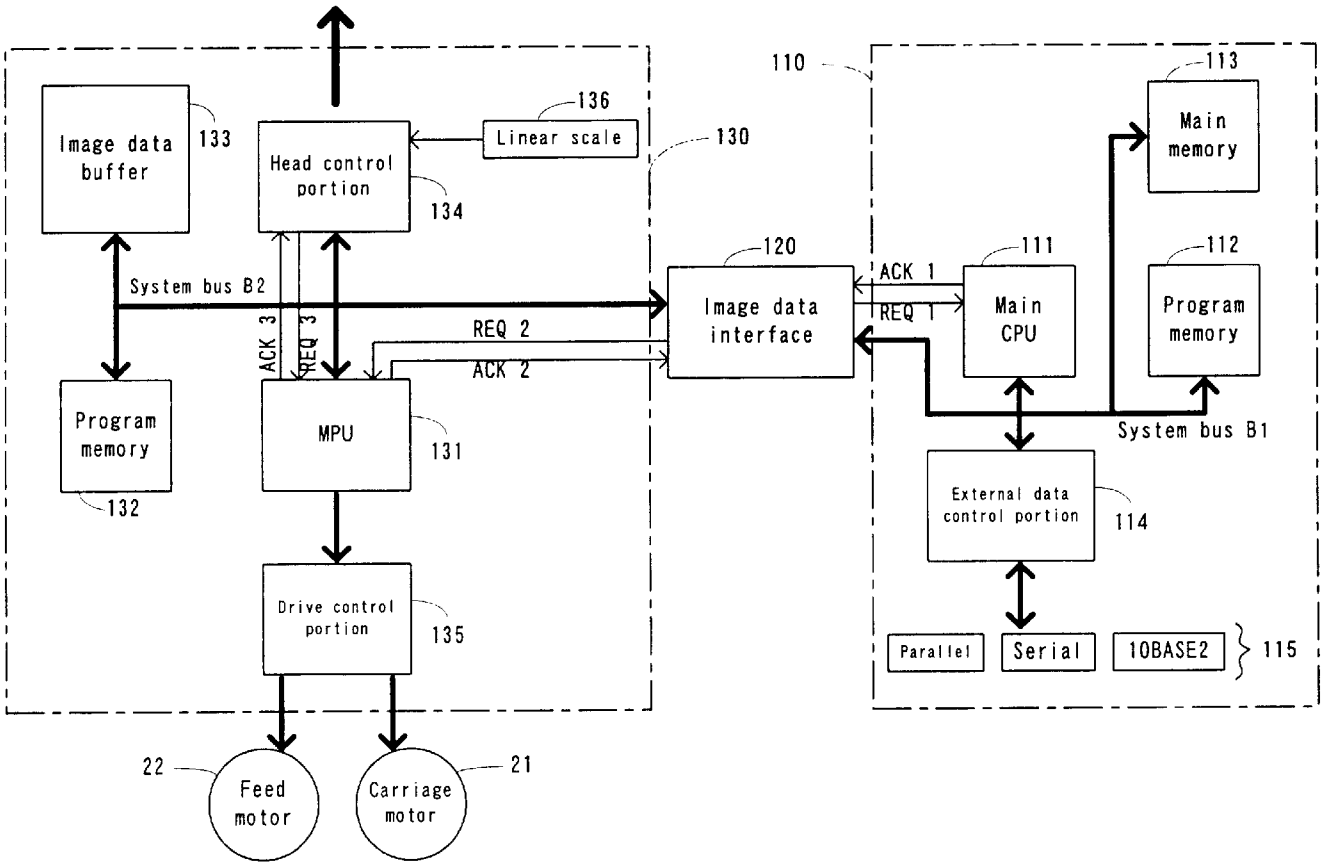
FIG. 3 is a block diagram of the control unit of the printing system of this embodiment.
Figure 4:
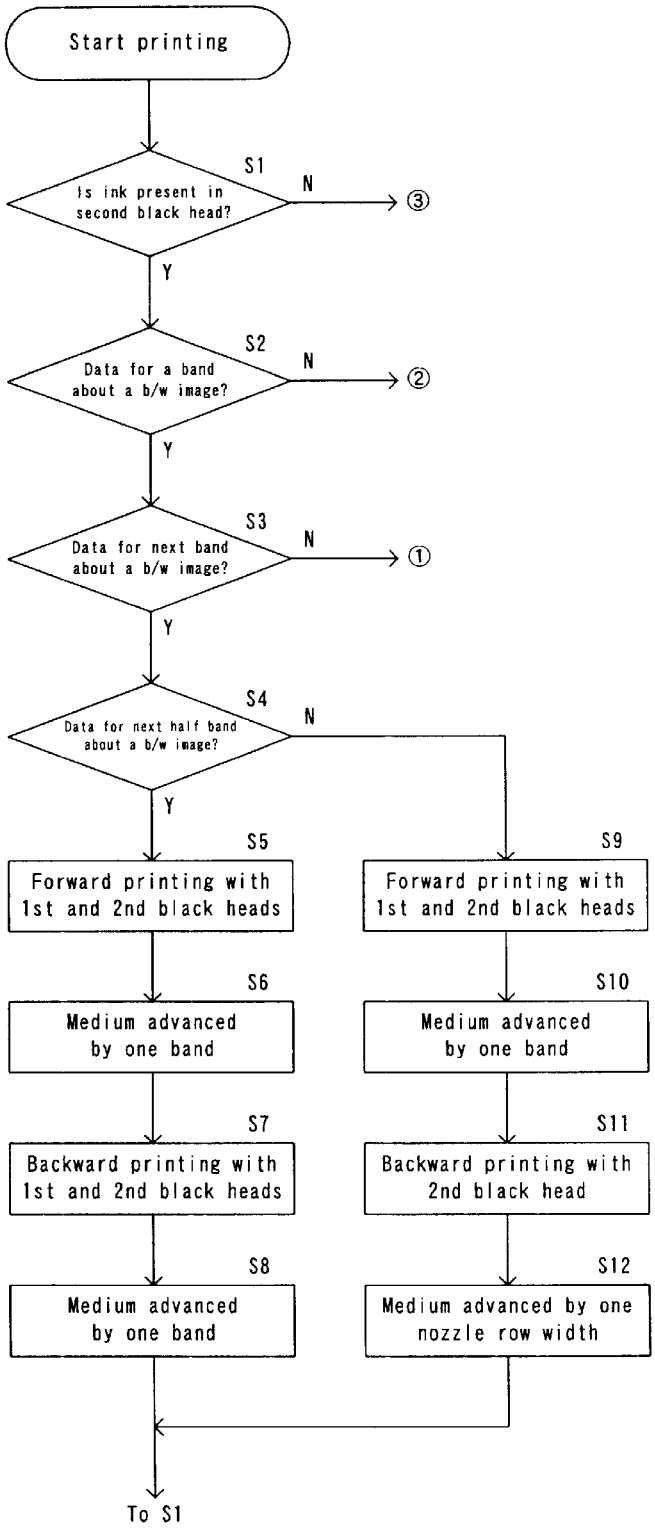
FIG. 4 is a flowchart for illustrating the printing operation of the printing system.
Figure 5:
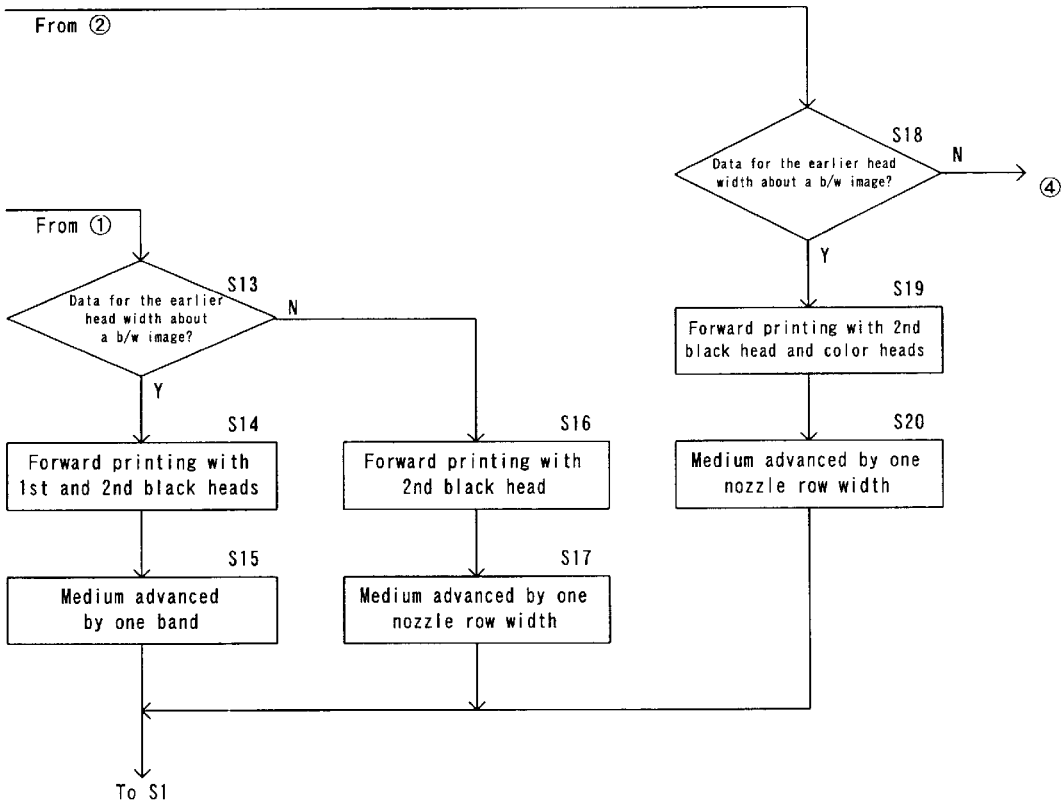
FIG. 5 is a flowchart for illustrating the printing operation of the printing system.
Figure 6:
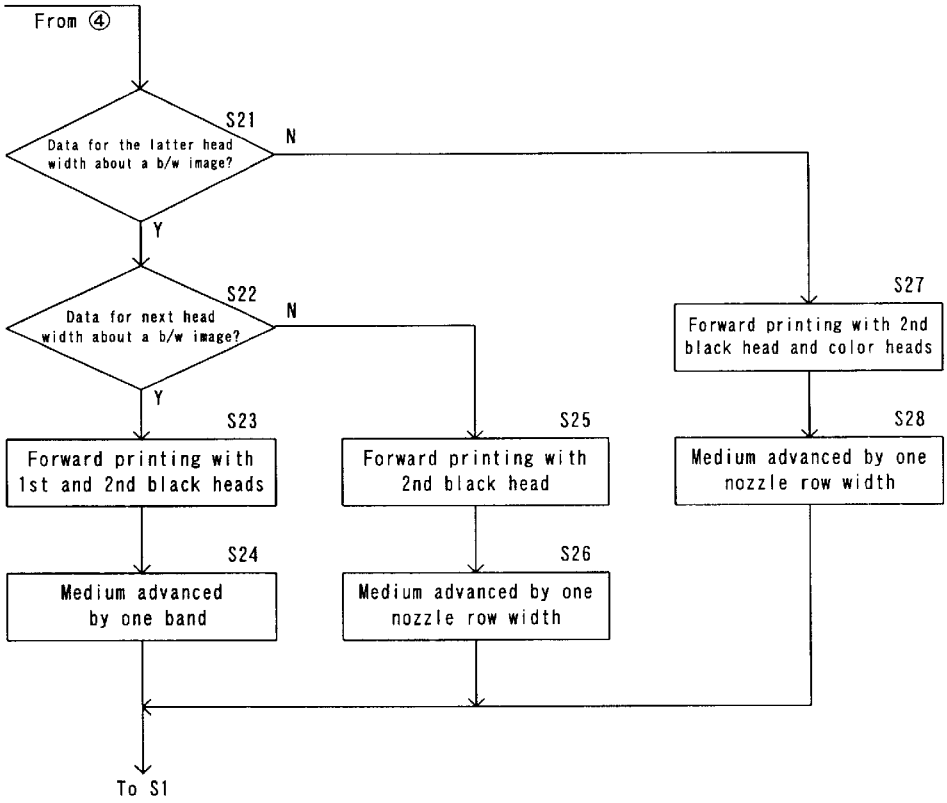
FIG. 6 is a flowchart for illustrating the printing operation of the printing system.
Figure 7:
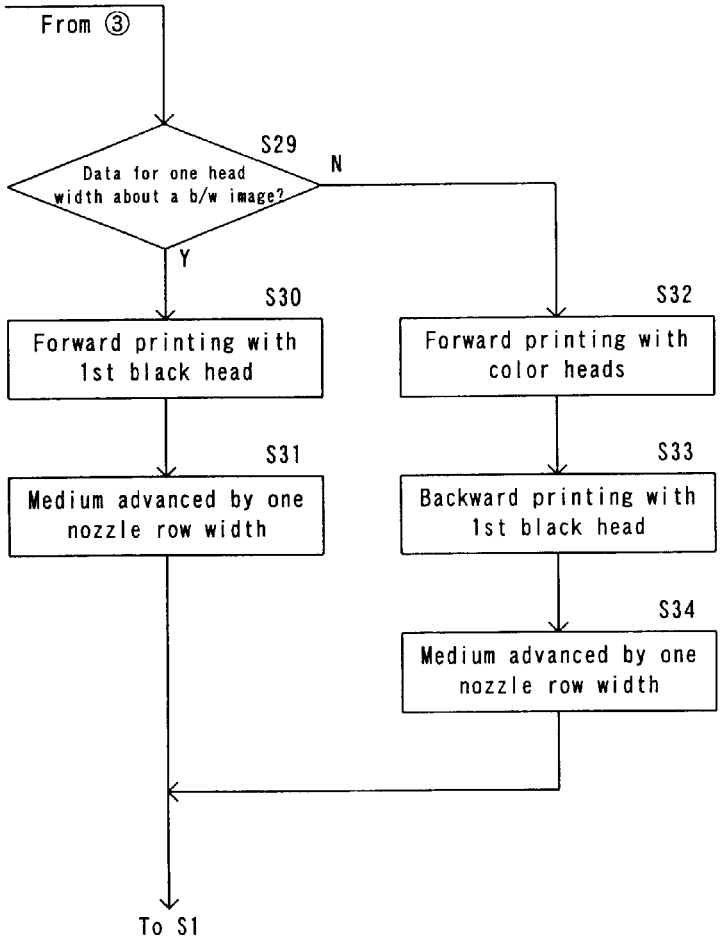
FIG. 7 is a flowchart for illustrating the printing operation of the printing system.

The most preferred embodiments for carrying out the invention disclosed in this Specification will be described with reference to the attached drawings. FIG. 1 is a schematic perspective view of the printer unit of a printing system representing an embodiment of this invention. FIG. 2(*a*) is a schematic lateral view of the printer head portion of the printing system, FIG. 2(*b*) a schematic bottom view of the same printer head portion, and FIG. 2(*c*) a partially enlarged schematic diagram of the printer head portion of FIG. 2(*b*). FIG. 3 is a block diagram of the control unit of the printing system of this embodiment.

The printing system of this embodiment comprises a printer unit 10 and a control unit 100 as shown in FIG. 1. Description will be given on the assumption that the printing system is a large format printer based on bubble jet printing. The printer unit 10 comprises a carriage 11, printer head portion 12, flexible flat cable (FFC) 13, guide 14, feed roller 15, a medium terminal end detection sensor 16, and an ink detection sensor 17.

The carriage 11 moves under the control of control unit 100, and, as shown in FIG. 1, it can move back and forth, driven by a carriage motor 21 (see FIG. 3), in a direction (carriage move direction) vertical to a direction in which a print medium 2 will be advanced (medium advance direction). Namely, the carriage 11 moves from a home position to a predetermined return position which is determined depending on the size of print medium 2, and then returns to the home position again. The carriage 11 incorporates a printer head portion 12. Because of this, the printer head portion 12 can also move back and forth together with carriage 11 in the carriage move direction.

The printer head portion 12 has a first black printer head 12*a*1 and a second black printer head 12*a*2 both to eject black (Bk) ink, and three color printer heads 12*b*1, 12*b*2 and 12*b*3 to eject cyan (C), magenta (M) and yellow (Y) inks respectively as shown in FIG. 1. The printer heads 12*a*1, 12*a*2, 12*b*1, 12*b*2, and 12*b*3 consist of cartridges, and whenever any one cartridge has its ink totally consumed, it is exchanged for a new one. Each of the printer heads 12*a*1, 12*a*2, 12*b*1, 12*b*2 and 12*b*3 has a row of ink nozzles (see FIG. 2(*c*)). The row of ink nozzles are arranged in a line in parallel with the medium advance direction. Incidentally, in this printing system, black inks prepared from pigments and colored inks prepared from dyes are used, as mentioned above.

The first black printer head 12*a*1, and three color printer heads 12*b*1, 12*b*2 and 12*b*3 are arrayed in parallel along the carriage move direction as shown in FIGS. 1 and 2(*b*). On the other hand, the second black printer head 12*a*2 is displaced by a specific distance with respect to the first black printer head 12*a*1 forward in the medium advance direction (downstream in the medium advance direction) as shown in FIGS. 1 and 2. The distance by which the second black printer head 12*a*2 should be displaced with respect to the first black printer head 12*a*1 is ideally equal to the nozzle row width of one printer head, and the second black printer head 12*a*2 should be positioned relative to the first black printer head 12*a*1 such that the nozzle row of the former continues with the nozzle row of the latter if projected on the same line in parallel with the medium advance direction, and the dots printed by the former do not overlap with those printed by the latter.

In actuality, however, when the second black printer head 12*a*2 is mounted to the carriage 11, a more or less positioning error inevitably intervenes, and thus it is often difficult to mount the second black printer head 12*a*2 to a desired position. In worst cases, there may occur a break in the medium advance direction between the nozzle row of the first black printer head 12*a*1 and that of the second black printer head 12*a*2. If the first and second black printer heads 12*a*1 and 12*a*2 were activated simultaneously for printing with such a break inserted between their nozzle rows as described above, the printed image would have a large number of streaks within, and thus would have a degraded quality. To avoid this, according to this embodiment, to compensate for the positioning error which more or less intervenes in association with assemblage, the second black printer head 12*a*2 is mounted with respect to the first black printer head 12*a*1 such that its nozzle row overlaps with that of the latter in the medium advance direction by a distance sufficient for spanning a few nozzles as shown in FIG. 2(*c*). If coupled printing with the first black printer head 12*a*1 and the second black printer head 12*a*2 is required, the control unit 100 controls those printer heads such that either the nozzles of the first black printer head 12*a*1 which overlap with those of the second black printer head 12*a*2, or the nozzles of the second black printer head 12*a*2 which overlap with those of the first black printer head 12*a*1 will be used for printing. And if simultaneous printing with the second black printer head 12*a*2 and the three color printer heads 12*b*1, 12*b*2 and 12*b*3 is required, the control unit 100 controls, for example, those printer heads so that the nozzles of the second black printer head 12*a*2 which overlap with those of the first black printer head 12*a*1 will be out of operation. Through this arrangement, it is possible according to this invention to prevent the dots printed by the second black printer head 12*a*2 from overlapping with those printed by the other printer heads 12*a*1, 12*b*1, 12*b*2 and 12*b*3.

Electric power and various signals are supplied to the printer heads 12*a*1, 12*a*2, 12*b*1, 12*b*2 and 12*b*3 by the control unit 100 through FFC 13. The guide 14 is for supporting FFC 13 on its top surface.

The feed roller 15 moves under the control of the control unit 100, and advances, being driven by a feed motor 22 (see FIG. 3), a print medium 2 in the medium advance direction shown in FIG. 1. Further in this embodiment, a plurality of small rollers 15*a* come in contact with the upper part of feed roller 15 through print medium 2.

A medium terminal end detection sensor 16 is for detecting the terminal end of print medium 2. If it detects the terminal end of print medium 2, the further advancement of print medium 2 will be arrested. An ink detection sensor 17 is for detecting whether or not any one of printer heads 12*a*1, 12*a*2, 12*b*1, 12*b*2 and 12*b*3 has completely consumed its ink. The sensor 17 can also detect a printer head that does not contain an ink cartridge. The signals from medium terminal end detection sensor 16 and ink detection sensor 17 will be sent to control unit 100.

If printing of an image on a print medium 2 is required, carriage 11 and print medium 2 will operate as follows. Namely, carriage 11 move back and force in the carriage move direction, and, during the movement, printer heads 12*a*1, 12*a*2, 12*b*1, 12*b*2 and 12*b*3 eject their inks at instructed timings. Through this operation, a part of the image is printed on the print medium 2. Then, print medium 2 is advanced by a specified distance in the medium advance direction, and the same operation consisting of the ejection of inks by those printer heads is repeated until the entire image is printed on the full expanse of print medium 2.

As described above, with this embodiment, the second black printer head 12*a*2 is displaced by a certain distance in the medium advance direction with respect to the array comprising the first black printer head 12*a*1, and three color printer heads 12*b*1, 12*b*2 and 12*b*3. Because of this feature, it is possible to print dots having, at maximum, a length corresponding to the sum of the two nozzle row widths of two printer heads that is the sum of the nozzle row width of the second black printer head 12*a*2 and that of the first black printer head 12*a*1, during the time at which carriage 11 moves from the home position to the return position. Here, with this embodiment, this maximum length of dots obtained during one stroke of carriage movement and corresponding to the sum of the two nozzle row widths of two printer heads will be termed a band.

Control unit 100 is for controlling the operation of printer unit 10, and comprises an image data generating portion 110, image data interface 120 and print engine control portion 130 as shown in FIG. 3. Image data interface 120 corresponds to a data property checking means of this invention, while print engine control portion 130 to a control means of this invention.

Image data generating portion 110 comprises a main CPU 111, program memory 112, main memory 113, external data control portion 114, and host computer interface 115. Program memory 112 stores programs necessary for the proper operation of image data generating portion 110. Communication of various kinds of data between main CPU 111 and other components within the portion 110 is achieved through a system bus B1. Print engine control portion 130 comprises an MPU 131, program memory 132, image data buffer 133, head control portion 134, drive control portion 135, and linear scale 136. Program memory 132 stores programs necessary for the proper operation of print engine control portion 130. Communication of various kinds of data between MPU 131 and other components within the portion 130 is achieved through a system bus B2.

Main CPU 111 receives data (raster data, vector data, etc.) from a host computer through a host computer interface 115 and an external data control portion 114. The host computer interface 115 may include a conventional parallel, serial or network (10BASE2) interface. Main CPU 111, on receipt of data, analyzes the data, converts them into raster-mode image data corresponding to the printer heads, and causes main memory 113 to store them. On the other hand, main CPU 111 writes the image data into image data interface 120 through DMA (REQ1, ACK1). Here DMA (direct memory access) represents a function of main CPU 111 which sends data directly to the interface using its hardware element instead of using its software element.

Image data interface 120 is for sending image data clustered in bands to the MPU 131 of print engine control portion 130. Data sent by the host computer have a header attached that indicates the kind of data, for example, whether the data convey black-and-white images or full color images. Image data interface 120 analyzes, based on the header attached to data, whether the data convey black-and-white images or full color images, for each image data cluster corresponding to a band. Specifically, with this embodiment, it is necessary to analyze whether the data convey black-and-white images or full color images for each image data cluster divided at each half of a band. To attain this, the image data interface 120 of this embodiment analyzes whether the data convey black-and-white images or full color images for each image data clustered in half bands, and sends the result for each image data clustered in half bands together with the image data clustered in bands to MPU 131.

MPU 131 writes the image data clustered in bands into image data buffer 133 through DMA (REQ2, ACK2). On the other hand, MPU 131 sends signals necessary for properly controlling the driving of carriage 11 and the advancement of print medium 2, to drive control portion 135. Then, drive control portion 135 drives carriage motor 21 and feed motor 22 into activation. MPU 131 has a further function of sending image data clustered in bands or in half bands, to the head control portion 134 through DMA (REQ3, ACK3), which are necessary for the proper control of the ink ejection of the printer heads 12*a*1, 12*a*2, 12*b*1, 12*b*2, and 12*b*3.

Linear scale 136 sends signals conveying the speed and position of carriage 11 to head control portion 134. The head control portion 134 creates control signals based on the image data sent from MPU 131 and the signals sent from linear scale 136, and sends the control signals to printer heads 12*a*1, 12*a*2, 12*b*1, 12*b*2 and 12*b*3 through an FFC 13. On receipt of the signals, printer heads 12*a*1, 12*a*2, 12*b*1, 12*b*2 and 12*b*3 eject their respective inks.

Next, the printing operation by the printing system of this embodiment will be described. FIGS. 4, 5, 6 and 7 are a flowchart for illustrating the printing operation of the printing system of this embodiment.

The operator sets a print medium 2 to a printer unit 10; data are sent from a host computer to an image data generating portion 110; and printing is started. Image data generating portion 110 generates, based on the data from the host computer, the image data corresponding to printer heads 12*a*1, 12*a*2, 12*b*1, 12*b*2 and 12*b*3, and sends them to an image data interface 120. Image data interface 120 then determines whether the image data concern with a black-and-white image or a full color image. It sends the result together with the image data clustered in bands to the MPU 131 of a print engine control portion 130.

An ink detection sensor 17 detects, at the start of printing or during printing, whether or not any one of printer heads 12*a*1, 12*a*2, 12*b*1, 12*b*2 and 12*b*3 has consumed its ink. Let's assume here for illustration that three color printer heads 12*b*1, 12*b*2 and 12*b*3 and the first black printer head 12*a*1 contain an ample amount of ink, while the second black printer head 12*a*2 has consumed its ink, which is detected by ink detection sensor 17.

Firstly, MPU 131, based on the signal from ink detection sensor 17, checks whether or not the second black printer head 12*a*2 contains ink (S1). If it finds the second black printer head 12*a*2 contains ink, MPU 131 checks, based on the result sent by image data interface 120, whether or not the image data for a given band concern with a black-and-white image (S2). If it finds the answer is affirmative, MPU 131 checks whether or not the image data for the next band that succeed the image data for the given band concern with a black-and-white image (S3). If it finds the answer is also affirmative, and the image data for two successive bands concern with a black-and-white image, MPU 131 proceeds to further check whether or not the image data next to the image data for the above two bands and having a width equal to the nozzle row width of one printer head (length equal to half a band) concern with a black-and-white image (S4). If reaching an affirmative conclusion at step S4, MPU 131 instructs head control portion 134 and drive control portion 135 to print the black-and-white image conveyed by the image data for the first two bands through the bidirectional printing by the first and second black printer heads 12*a*1 and 12*a*2. Specifically, during the time at which carriage 11 moves from the home position to the return position, the first and second black printer heads 12*a*1 and 12*a*2 are simultaneously activated to achieve the forward printing of a black-and-white image for the first band (S5). Next, after a print medium 2 is advanced by a distance equal to the length of one band in the medium advance direction (S6), carriage 11 is returned from the return position to the home position, and meanwhile the first and second black printer heads 12*a*1 and 12*a*2 are simultaneously activated to achieve the backward printing of the black-and-white image for the second band (S7). Through this operation, the black-and-white image for the two bands is printed on the print medium 2. Later, the print medium 2 is advanced by a distance equal to the length of one band in the medium advance direction (S8), and process proceeds to step S1.

If reaching a negative conclusion at step S4, MPU 131 firstly activates the first and second black printer heads 12*a*1 and 12*a*2 simultaneously during the time at which carriage 11 moves from the home position to the return position, thereby achieving the forward printing of a black-and-white image for the first band (S9). Next, after a print medium 2 is advanced by a distance equal to the length of one band in the medium advance direction (S10), carriage 11 is returned from the return position to the home position, and meanwhile only the second black printer head 12*a*2 is activated to achieve, based on the black-and-white image data for the second band, the backward printing of the image for the earlier half of the second band equal in length to the nozzle row width of one printer head (S11). Then, the print medium 2 is advanced by a distance equal to the nozzle row width of one printer head in the medium advance direction (S12), and process proceeds to step S1.

If MPU 131 finds the image data for the second band that succeed the black-and-white image data for the first band do not concern with a black-and-white image at step S3, MPU 131 proceeds to check the image data for the second band which have been found not to concern with a black-and-white image at step S3: it checks whether or not the image data for the earlier half of the second band equal in length to the nozzle row width of one printer head concern with a black-and-white image (S13). If reaching an affirmative conclusion at step S13, MPU 131 instructs the first and second black printer heads 12*a*1 and 12*a*2 to print a black-and-white image for the first band based on the image data for the first band which have been found to concern with a black-and-white image at step S2. To attain this, firstly, carriage 11 moves from the home position to the return position, and meanwhile the first and second black printer heads 12*a*1 and 12*a*2 are simultaneously activated, thereby achieving the forward printing of a black-and-white image for the first band (S14). Next, carriage 11 is returned from the return position to the home position. Through this operation, the black-and-white image for the first band is printed on a print medium 2. Then, the print medium 2 is advanced by a distance equal to the length of one band in the medium advance direction (S15), and process proceeds to step S1.

If reaching a negative conclusion at step S13, MPU 131, of the image data for the first band which were found to concern with a black-and-white image at step S2, applies the image data for the earlier half of the first band equal in length to the nozzle row width of one printer head to the second black printer head 12*a*2, to print a black-and-white image for the earlier half of the first band. To attain this, firstly, carriage 11 moves from the home position to the return position, and meanwhile only the second black printer head 12*a*2 is activated to achieve the forward printing of a black-and-white image having a width equal to the nozzle row width of one printer head (S16). Next, carriage 11 is returned from the return position to the home position. Then, the print medium 2 is advanced by a distance equal to the nozzle row width of one printer head in the medium advance direction (S17), and process proceeds to step S1.

If MPU 131 finds the image data for the first band do not concern with a black-and-white image at step S2, it checks, of the image data for the first band, whether or not the image data for the earlier half of the first band equal in length to the nozzle row width of one printer head concern with a black-and-white image (S18). If MPU 131 finds the image data for the earlier half of the first band concern with a black-and-white image, it concludes the image data for the earlier half of the first band concern with a black-and-white image while the image data for the latter half of the first band concern with a full color image, and instructs the second black printer head 12*a*2 and three color printer heads 12*b*1, 12*b*2 and 12*b*3 to print those images for the first band. Specifically, firstly, carriage 11 moves from the home position to the return position, and meanwhile the second black printer head 12*a*2 and three color printer heads 12*b*1, 12*b*2 and 12*b*3 are activated simultaneously, to achieve the forward printing of the images for the first band (S19). Next, carriage 11 is returned from the return position to the home position. Then, the print medium 2 is displaced by a distance equal to the nozzle row width of one printer head in the medium advance direction (S20), and process proceeds to step S1.

With this embodiment, the second black printer head 12*a*2 is displaced by a certain distance in the medium advance direction with respect to the array comprising color printer heads 12*b*1, 12*b*2 and 12*b*3. Therefore, the dots printed by the second printer head 12*a*2 do not overlap with those printed by color printer heads 12*b*1, 12*b*2 and 12*b*3. If this embodiment is used for printing a full color image having a width equal to the nozzle row width of one printer head, color printer heads 12*b*1, 12*b*2 and 12*b*3 are activated at first, then the second black printer head 12*a*2 is activated, to print a full color image having a width equal to the nozzle row width of one printer head on the print medium 2.

If MPU 131 finds, of the image data for the first band, the image data for the earlier half of the first band equal in length to the nozzle row width of one printer head concern with a full color image at step S18, it proceeds to check whether or not the image data for the latter half of the first band equal in length to the nozzle row width of one printer head concern with a black-and-white image (S21). If reaching a conclusion that the image data for the latter half of the first band in question concern with a black-and-white image, MPU 131 proceeds to further check whether or not the image data for the earlier half of the second band equal in length to the nozzle row width of one printer head that succeed the image data for the latter half of the first band, concern with a black-and-white image (S22).

If reaching an affirmative conclusion at step S22, MPU 131 assigns the image data for the first band whose chromatic property was determined by MPU 131 at step S2, to the first and second black printer heads 12*a*1 and 12*a*2 for printing. It should be noted here, the image data for the earlier half of the first band which concern with a full color image were already submitted to color printer heads 12*b*1, 12*b*2 and 12*b*3 for printing at step S19, or at step S27 which will be described below. To return to the image data for the first band here concerned, firstly, carriage 11 moves from the home position to the return position, and meanwhile the first and second black printer heads 12*a*1 and 12*a*2 are activated simultaneously, to achieve the forward printing of the image for the band (S23). Next, carriage 11 is returned from the return position to the home position. Then, the print medium 2 is advanced by a distance equal to the length of one band in the medium advance direction (S24), and process proceeds to step S1.

If reaching a negative conclusion at step S22, MPU 131 assigns, out of the image data for the band whose chromatic property has been determined by MPU 131 at step S2, full color image data for the earlier half of the band to the second black printer head 12*a*2 to print an image based on the image data for the earlier half of the band. It should be noted here, printing based on the full color image data for the earlier half of the band was already done through color printer heads 12*b*1, 12*b*2 and 12*b*3 at step S19, or at step S27 which will be described below. To return to the image data here concerned, firstly, carriage 11 moves from the home position to the return position, and meanwhile only the second black printer head 12*a*2 is activated, to achieve the forward printing of an image based on the color image data for the earlier half of the band (S25). Next, carriage 11 is returned from the return position to the home position. Then, the print medium 2 is advanced by a distance equal to the nozzle row width of one printer head in the medium advance direction (S26), and process proceeds to step S1.

If MPU 131 finds the image data for the latter half of the band concern with a full color image at step S21, it instructs the second black printer head 12*a*2, and three color printer heads 12*b*1, 12*b*2 and 12*b*3 to print an image based on the image data for the band whose chromatic property was determined by MPU 131 at step S2. It should be noted here, with regard to the color image data for the earlier half of the band, printing was already done through color printer heads 12*b*1, 12*b*2 and 12*b*3. To return to the image data here concerned, firstly, carriage 11 moves from the home position to the return position, and meanwhile the second black printer head 12*a*2 and the three color printer heads 12*b*1, 12*b*2 and 12*b*3 are simultaneously activated, to achieve the forward printing of a full color image for the band (S27). Next, carriage 11 is returned from the return position to the home position. Then, the print medium 2 is advanced by a distance equal to the nozzle row width of one printer head in the medium advance direction (S28), and process proceeds to step S1.

Incidentally, with regard to the medium feed mechanism of this printing system, the distance between feed roller 15 and the second black printer head 12*a*2 is far larger than the distance between feed roller 15 and the first black printer head 12*a*1, as shown in FIG. 2(*a*). Because of this, the inconvenience as described below may result. Namely, if it is required to print a full color image having a width equal to the nozzle row width of one printer head on a print medium 2 at the terminal end of its printable space, at that terminal end, firstly color printer heads 12*b*1, 12*b*2 and 12*b*3 and then the second black printer head 12*a*2 must be activated for the printing of that image. However, when printing through the color printer heads is completed, and the print medium 2 is advanced so as to allow the second black printer head 12*a*2 to face a proper position at the terminal end, the terminal end of print medium 2 will depart from feed roller 15. Therefore, unless proper measures are taken for this, it will be impossible for the second black printer head 12*a*2 to exercise a proper printing on the terminal end of the printable space of a print medium 2. However, it is possible to avoid this problem regarding the printing at the terminal end of the printable space of a print medium 2 by firstly allowing color printer heads 12*b*1, 12*b*2 and 12*b*2 to exercise printing, and then by allowing the first black printer 12*a*1 to exercise printing, without moving the print medium 2.

Next, the flow of processes will be described, which will result if MPU 131, on receipt of a signal from ink detection sensor 17 at step S1, concludes the second black printer head 12*a*2 has totally consumed its ink. In this case, only the first black printer head 12*a*1, and three color printer heads 12*b*1, 12*b*2 and 12*b*3 are operable, and thus, printing will proceed as in the conventional machine. Specifically, MPU 131 checks, based on the result sent by image data interface 120, whether or not the current image data having a width equal to the nozzle row width of one printer head concern with a black-and-white image (S29). If it finds the data in question concern with a black-and-white image, MPU 131 instructs the first black printer head 12*a*1 to exercise the printing of an image based on the image data having a width equal to the nozzle row width of one printer head. Specifically, firstly, carriage 11 moves from the home position to the return position, and meanwhile the first black printer head 12*a*1 is activated to achieve the forward printing of an image based on the image data having a width equal to the nozzle row width of one printer head (S30). Next, carriage 11 is returned from the return position to the home position. Through this operation, a black-and-white image having a width equal to the nozzle row width of one printer head is printed on a print medium 2. Then, the print medium 2 is advanced by a distance equal to the nozzle row width of one printer head in the medium advance direction (S31), and process proceeds to step S1.

On the contrary, if MPU 131 finds the image data having a width equal to the nozzle row width of one printer head concern with a full color image at step S29, it causes the first black printer head 12*a*1 and three color printer heads 12*b*1, 12*b*2 and 12*b*3 to be activated separately to achieve the printing of an image based on the color image data having a width equal to the nozzle row width of one printer head. Specifically, firstly, carriage 11 moves from the home position to the return position, and meanwhile the three color printer heads 12*b*1, 12*b*2 and 12*b*3 are activated to achieve the forward printing of the image (S32). Then, carriage 11 is returned from the return position to the home position, and meanwhile the first black printer head 12*a*1 is activated to achieve the backward printing (S33). Through this operation, a full color image having a width equal to the nozzle row width of one printer head is printed on a print medium 2. Then, the print medium 2 is advanced by a distance equal to the nozzle row width of one printer head in the medium advance direction (S34), and process proceeds to step S1.

According to the printing system of this embodiment, the second black printer head is displaced by a certain distance in the medium advance direction with respect to the first black printer head and plural color printer heads, and dots printed by the second black printer head do not overlap with those printed by the first black printer head and by plural color printer heads within any given band. Further, the print engine control portion, when it finds the image data for a given band concern with a full color image, causes the second black printer head and plural color printer heads to be activated to print an image based on the image data for the band. Through this arrangement it is possible to minimize the likeliness that black dots and colored dots are printed simultaneously and adjacently, thereby minimizing the likeliness of the black dots being blurred, and thus ensuring the high quality of the image.

Furthermore, the print engine control portion, when it finds the image data for a given band concern with a black-and-white image, causes the first and second black printer heads to be simultaneously activated to print an image based on the image data for the band, thereby accelerating the printing speed. Particularly, when it finds the image data for two successive bands concern with a black-and-white image, it causes the first and second black printer heads to exercise bidirectional printing of an image based on the image data for the two bands, which will further increase the printing speed. Moreover, if it is necessary to print an image based on the colored image data for half a band, the conventional printing system will firstly print the image using plural color printer heads, and then print the image using a black printer head while keeping a print medium at the same position. In contrast, this embodiment causes plural color printer heads to print the image, advances a print medium by a distance equal to the length of half a band, and then causes the second black printer head to print the image. This also contributes to the acceleration of the printing speed. As shown above, according to the printing system of this embodiment, it is possible to optimize the printing of a full color image or of a black-and-white image for each band or for each half a band.

The embodiment further incorporates an ink detection sensor which detects the voiding of ink in the second black printer head, and the print engine control portion, on receipt of a signal from the ink detection sensor informing the voiding of ink in the second black printer head, causes the first black printer head to be activated, instead of the second black printer head, to continue printing without interruption to the end, which will contribute to the reduction of cost by preventing the wasteful use of print medium.

This invention, however, is not limited to the above embodiment, and various modifications will be possible within the scope of this invention.

To mention a few for illustration, although description has been given about the embodiment where the second black printer head is displaced forward by a certain distance in the medium advance direction with respect to the first black printer head (downstream in the medium advance direction), the second black printer head may be displaced backward in the medium advance direction with respect to the first black printer head.

INDUSTRIAL APPLICABILITY

As described above, according to the printing system of this invention, the second black printer head is displaced by a certain distance in the medium advance direction with respect to the first black printer head and plural color printer heads, and the dots printed by the second black printer head do not overlap with those printed by the first black printer head and by plural color printer heads within any given band. Through this arrangement it is possible to minimize the likeliness that black dots and colored dots are printed simultaneously and adjacently, thereby minimizing the likeliness of the black dots being blurred, and thus ensuring the high quality of the image. It is possible according to these features for the printing system of this invention to be beneficially used as a printer or plotter incorporating plural printer heads for color printing.

What is claimed is:

1. A printing system comprising:

a first black printer head having a row of nozzles to eject black ink and a plurality of color printer heads each having a row of nozzles to eject colored inks other than black ink, all of which are arrayed in parallel along the direction in which a carriage moves;

a second black printer head having a row of nozzles to eject black ink which is displaced by a nozzle row width of one head in the direction in which a print medium will be transferred, with respect to the array comprising the first black printer head and the plurality of color printer heads, whereby it is possible for the second black printer head to print dots such that the dots do not overlap with those printed by the first black printer head or by the plural color printer heads within any given band; and a control means to, when color printing is performed for the nozzle row width of one head, first perform printing by a head from the plurality of color printer heads and the second black printer head, positioned on the upstream side of the direction in which the print medium will be transferred, then transfer the print medium by the nozzle row width of one head, and perform printing by a head positioned on the downstream side.

2. A printing system as described in claim 1, further comprising:

a data property checking means to check whether the image data for a given band concern with a black-and-white image or a full color image, wherein when the data property checking means finds the image data for a band concern with a full color image, the control means causes the second black printer head and the plural color printer heads to exercise printing of the image based on the image data for the band.

3. A printing system as described in claim 2 wherein the control means, when the data property checking means finds the image data for a band concern with a full color image, and printing of the image based on the image data for the band must be performed on the terminal end of a sheet of recording paper, causes the plural color printer heads to exercise printing and then the first black printer head to exercise printing.

4. A printing system as described in claim 3, wherein the control means, when the data property checking means finds the image data for a band concern with a black-and-white image, causes the first and second black printer heads to simultaneously exercise printing of the image based on the image data for the band.

5. A printing system as described in claim 2 further comprising an ink detection means to detect the voiding of ink of the second black printer head, wherein the control means, on receipt of a signal from the ink detection means informing the voiding of ink of the second black printer head, causes the first black printer head to exercise printing, in place of the second black printer head.

6. A printing system as described in claim 2, wherein the control means, when the data property checking means finds the image data for a band concern with a black-and-white image, causes the first and second black printer heads to simultaneously exercise printing of the image based on the image data for the band.

7. A printing system as described in claim 6 wherein the control means, when the data property checking means finds the image data for two successive bands concern with a black-and-white image, causes the first and second black printer heads to exercise bidirectional printing of the image based on the image data for the two bands.

8. A printing system as described in claim 1, wherein the first black printer head and the plurality of color-printer heads are arrayed along the direction in which the print medium will be transferred such that the nozzles of the first black printer head and the plurality of color printer heads overlap with each other by one or more nozzles, and wherein when printing is performed by simultaneously using the first black printer head and the second black printer head, regarding the overlapped nozzles, the control means performs control to drive any one of the overlapped nozzles, and when printing is performed by using the second black printer head and the plurality of color printer heads, the control means performs control not to drive the overlapped nozzles of the second black printer head.

* * * * *